US006027060A

United States Patent [19]

Siepmann

[11] Patent Number: 6,027,060

[45] Date of Patent: Feb. 22, 2000

[54] METHOD OF WINDING A YARN TO A CYLINDRICAL CROSS-WOUND PACKAGE

[75] Inventor: Peter Siepmann, Schwelm, Germany

[73] Assignee: Barmag AG, Remscheid, Germany

[21] Appl. No.: 09/065,779

[22] Filed: Apr. 23, 1998

[30] Foreign Application Priority Data

Apr. 24, 1997 [DE] Germany ..... 197 17 247

[51] Int. Cl.[7] ..... B65H 69/04

[52] U.S. Cl. ..... 242/447.6

[58] Field of Search ..... 242/476.7, 477.6, 242/477.4, 477.5

[56] References Cited

U.S. PATENT DOCUMENTS

| | | | |
|---|---|---|---|
| 4,296,899 | 10/1981 | Martens . | |
| 4,504,021 | 3/1985 | Schippers et al. . | |
| 4,504,024 | 3/1985 | Gerhartz . | |
| 4,667,889 | 5/1987 | Gerhartz | 242/477.6 |
| 4,697,753 | 10/1987 | Schippers et al. | 242/477.6 |
| 4,771,961 | 9/1988 | Sugioka | 242/477.4 |
| 5,056,724 | 10/1991 | Prodi et al. | 242/477.6 |
| 5,348,238 | 9/1994 | Yamauchi et al. | 242/476.7 |
| 5,447,277 | 9/1995 | Schluter et al. | 242/477.6 |

FOREIGN PATENT DOCUMENTS

| | | |
|---|---|---|
| 0 055 849 | 7/1982 | European Pat. Off. . |
| 0 194 524 | 6/1989 | European Pat. Off. . |
| 0 578 966 | 1/1994 | European Pat. Off. . |

*Primary Examiner*—Michael R. Mansen
*Attorney, Agent, or Firm*—Alston & Bird LLP

[57] ABSTRACT

A method of winding a yarn to a cylindrical cross-wound package in a step precision wind, wherein the diameter of the cross-wound package that is to be wound in one step is divided on the circumference by an integral number of divisions into several band widths. Each of the band widths is filled with a predetermined number of yarns with a predetermined overlap to form a layer. After completing a layer, a new division is made on the package circumference. In the event that a higher number of divisions results, a new winding ratio is computed and wound in the subsequent step of the winding process.

12 Claims, 3 Drawing Sheets

METHOD OF WINDING A YARN TO A CYLINDRICAL CROSS-WOUND PACKAGE

BACKGROUND OF THE INVENTION

The present invention relates to a method of winding a yarn into a cylindrical cross-wound package in a step precision wind.

When winding synthetic filament yarns to cross-wound packages, there arises the problem of a so-called "ribbon formation." As the diameter of a package increases, a ribbon always forms when one or more complete package revolutions occur per double stroke, i.e., when the ratio of the rotational package speed to the double stroke frequency of the yarn traversing mechanism is equal to 1, an integral multiple, or an integral fraction. A double stroke is defined as a complete forward and back movement of a traversing yarn guide. The ratio of rotational speed of the cross-wound package to the double stroke frequency of the traversing mechanism is generally designated as the winding ratio K. The ribbons, which are also named ribbon winds, lead to certain disturbances when unwinding the yarn. Furthermore, during the winding, ribbons lead to vibrations of the takeup machine and, thus, to an uneven contact of the contact pressure roll on the package, and finally also to damage of the package. It is therefore necessary to avoid ribbons in particular in the case of flat yarns, such as, for example, synthetic fibers.

The winding of yarns to cross-wound packages may occur in random wind, precision wind, or in a step precision wind. In the case of the random wind, the package is built up at a constant circumferential speed of the package and at a constant traversing frequency. This results in that the winding ratio K, which represents the ratio of winding spindle speed to double stroke rate of the traversing mechanism, decreases constantly in the course of a winding cycle. This is caused by the fact that the rotational speed of the winding spindle decreases likewise as the package diameter increases. In this process, ribbons are bound to form, when the winding ratio becomes an integer or assumes values which differ from the next whole-numbered wind ratio by a common fraction. A "common" fraction denotes a fraction, whose denominator is a whole number, such as, for example ½; ⅓; ¼.

In a precision wind, the package is built up at a traversing speed, which is directly proportional to the rotational speed of the winding spindle. This means that in a precision wind, the winding ratio is a predetermined constant and remains constant in the course of the winding cycle, whereas the traverse frequency decreases proportionately to the winding spindle speed with the winding ratio being the factor of proportionality. In comparison with a package wound in random wind, a package wound in precision wind has certain advantages. In particular, a precision wind facilitates reduction of the ribbon formation by predetermining the winding ratio.

The so-called stepped precision wind or also step precision wind (SPW) differs from the precision wind only in that the winding ratio remains constant only during predetermined phases of the winding cycle. From phase to phase, the winding ratio is decreased in steps by a sudden increase of the traversing speed. This means that in the step precision wind, a precision wind occurs within each phase or step, during which the traversing speed decreases proportionately to the spindle speed. After each phase, the traversing speed is again suddenly increased, so as to result in a decreasing winding ratio. In so doing, the winding ratios, which are to be maintained during the individual phases are previously computed and programmed.

EP 0 578 966 B1 discloses a winding method, wherein a computer determines the winding ratio from step to step of a step precision wind and compares same with critical ribbon values. In this instance, one operates with computed winding ratios, when same are not within the critical range of a ribbon value. However, when a winding ratio is within the critical range, one will operate only with a slightly modified winding ratio. This means, that in the case of critical ribbon values one will operate with so-called (near-to-ribbon) winding ratios, which represent a winding ratio that differs from a ribbon value by a defined slight difference. Likewise disclosed is that the spacing of the yarn displacement is related to the distance between yarn centers. This displacement spacing is at least equal to the width and at most equal to three times the width of the overlying yarn. This means, that the yarn thickness is considered in the takeup operation.

EP 0 194 542 B1 discloses a method of winding yarn, in particular synthetic filament yarns in spin and draw machines. In this method the step precision wind is applied, and an inaccuracy of the winding ratio is deliberately generated. A modulation of the winding ratio is realized in a certain modulation width, in which the traversing speed changes by a small defined amount with respect to a computed and programmed value of the traversing speed.

Furthermore, EP 0 055 849 B1 discloses a method of winding yarns or tapes in a step precision wind, wherein the change of the winding ratio from one step of the precision wind to the next is made so small that the thereby caused changes in the takeup speed of the yarn or tape do not exceed 3%, preferably 0.3% of the average takeup speed.

Common to all known methods of the prior art is that they are unable to prevent primarily ribbon formations of a higher order or even honeycomb formations, i.e., to take also into account primarily rare ribbons, and that therefore even a step precision wind, as is known from the state of the art, is unable to prevent ribbon formations in general.

It is therefore the object of the invention to provide a method of winding yarns, which permits the reliable production of cylindrical cross-wound packages with satisfactory unwinding characteristics, i.e, substantially without ribbons of even a higher order and of a rarer kind and without honeycombs.

SUMMARY OF THE INVENTION

The above and other objects and advantages of the present invention are achieved by the provision of a stepped precision winding process wherein the yarn is deposited on the package circumference at a predetermined winding ratio within predetermined bands of constant width. The bands of constant width are in this instance defined as so-called band widths B. The band width B, which defines the spacing between two adjacently deposited yarns or the spacing between adjacent reversal points, is determined by the traversing frequency and the circumferential speed of the package. The band width is predetermined such that a plurality of band widths can be symmetrically arranged, one after the other, on the momentarily wound package circumference. This results in an integral number of divisions T from the equation $T=D\cdot\pi/B$. The integral number of divisions T thus indicates the number of the band widths B distributed over the package circumference. As the winding cycle progresses, each band width on the package circumference is filled to one layer with a predetermined number of deposited yarns, with the yarns lying on the package circumference with a defined overlapping. In this connection, a deposited yarn is the yarn length, which is deposited on the package circumference during one double stroke of the traversing yarn guides. After the layer is formed and before starting a new layer, a new band width $B_2$ is determined for the newly forming package diameter. In this instance, only an integral number of band widths is allowed. Should it be found from determining the band width $B_2$ that a certain limit value is reached, the winding ratio of the newly forming package diameter will be computed. Subsequently, the traversing speed is suddenly increased to the changed winding ratio, and winding proceeds in the adjacent step.

The special advantage of the method in accordance with the invention lies in that it is not possible to wind ribbons, since the yarn layers and the overlaps of the yarns are always predetermined. Therefore, this method does not require to predetermine the ribbon values. In addition, by predetermining the overlap of the yarns on the package circumference, an even and stable package buildup is realized.

The predeterminations of a band width $B_1$ as well as the predetermination of the yarns A deposited within the band width are dependent on the parameters of the wound yarn, such as denier, number of filaments, and cross section, as well as on the desired package buildup, and they are determined before the start of the winding cycle.

In a preferred embodiment, the traversing frequency is suddenly changed, when the determination of the band width $B_2$ results in a next higher multiple of the newly wound package diameter. This is especially advantageous for larger package diameters, since the diameter increase is correspondingly large and readily permits determination of a next higher multiple of the band width. In this connection, the number of deposited yarns within the band width as well as the overlap of the yarns can be kept constant, so that the band width remains likewise constant ($B_1=B_2$).

To obtain also for small package diameters an as constant as possible overlap of the yarns on the package surface, the variant of the method is of advantage, wherein a limit value is determined by a maximum number of deposited yarns $A_{max}$ which can be deposited within a band width. In this instance A is enlarged such that the increasing diameter is compensated, and that it is thus possible to maintain a constant multiple of the band width. This continues until $A_{max}$ is reached. Now, a new number of divisions T is determined, and the band width and the number of deposited yarns are predetermined. Thereafter, a new winding ratio is computed, so that the traversing frequency can be suddenly increased for winding the next step.

The predetermination of a minimum number of yarns $A_{min}$ that are to be deposited, facilitates in addition the determination of the jump width between two adjacent steps. Thus, it is possible to wind a package having an approximately constant winding angle with a correspondingly large number of steps, or a package with considerably changing winding angles and a small number of steps.

A further preferred variant of the method permits winding of a package with a constant band width as well as a constant number of deposited yarns within the band width. In this instance, the overlap of the yarns can be varied up to an maximum value $Q_{max}$. This method is especially of advantage, when it comes to realize a great packing density in the package buildup.

To avoid random winds, the overlap Q is always smaller than the width of the deposited yarn F. Preferably, the overlap Q of the yarns is in a range of values $0 \leqq Q \leqq 0.5 \cdot F$.

In a further variant, a minimal overlap is predetermined, so as to ensure that a uniform mass distribution exists on the package surface and that no gaps form between the yarns on the package circumference.

In a further, especially advantageous embodiment of the invention, it is possible to change the traversing frequency only within a predetermined upper limit and a predetermined lower limit. This allows to ensure that the tension of the yarn remains on the package within certain limits, so as to realize a proper package buildup.

The method of the present invention realizes a step precision wind with a high flexibility with respect to the package build up. The traversing frequency can in this instance be controlled irrespective of the package diameter. For example, if the number of deposited yarns is predetermined as a limit value, it will be possible to calculate in advance from the diameter increase per unit time the number of yarns or the number of double strokes, so that the traversing frequency can be changed as a function of time.

Further advantages and possible applications of the invention are now explained in more detail with reference to the description of an embodiment and to the Figures.

DETAILED DESCRIPTION OF THE PREFERRED EMBODIMENTS

Figure 1:
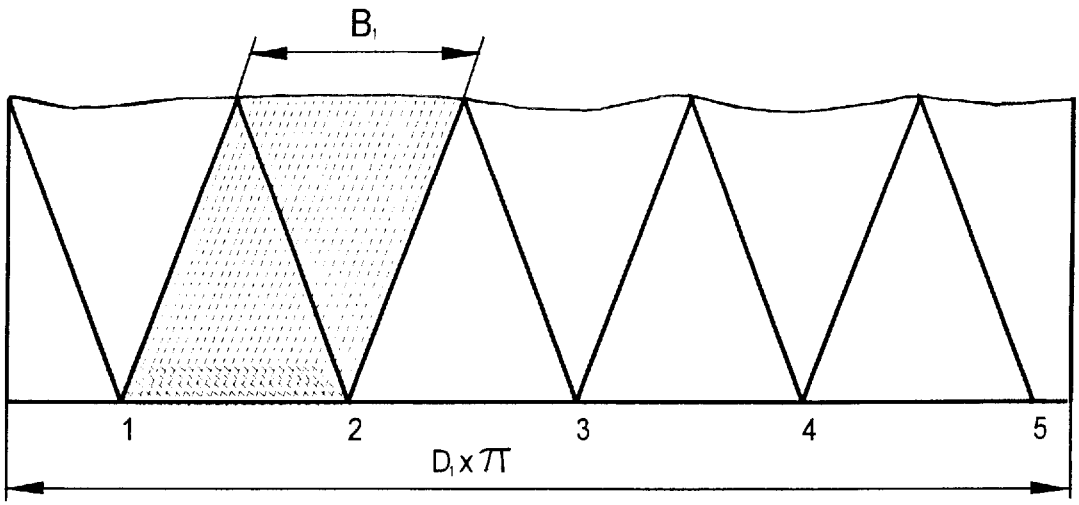
FIG. 1 is a development of a package with a division into band widths.
Figure 2:
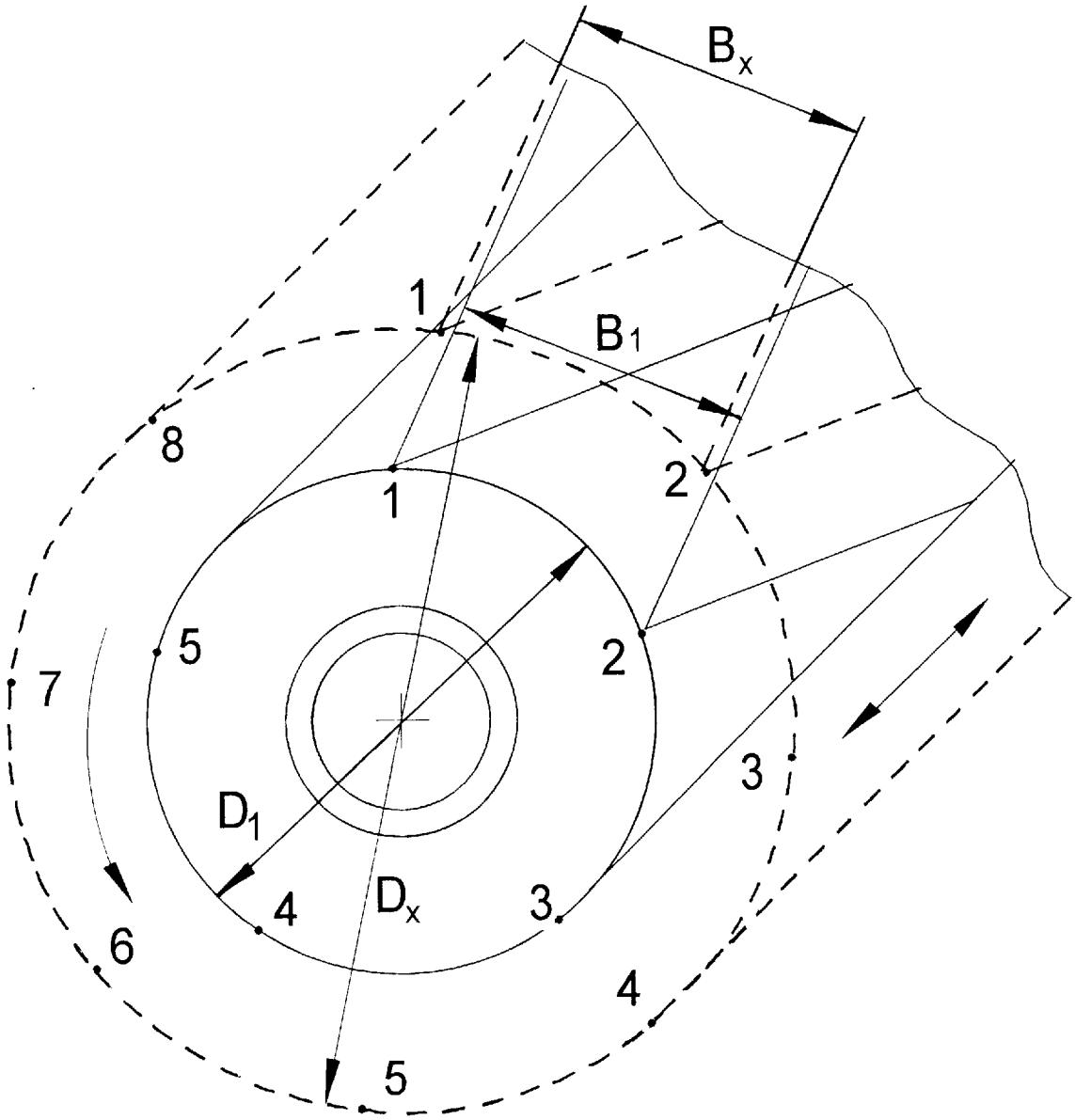
FIG. 2 is a front view of a package with established band widths.

FIGS. 1 and 2 illustrate how a package diameter D is evenly divided into a number of band widths B. The band width B results in this instance from the spacing between two adjacent yarns that are deposited at a predetermined winding ratio. As can be noted from the development of the package diameter (FIG. 1), the circumference of the package diameter is divided into a number T of band widths B. The stroke reversal points of a traversing yarn guide are indicated by numerals 1 to 5. From this results the correlation $D \cdot \pi = T \cdot B$ or for the number of divisions $T = \pi \cdot D/B$. The yarns are deposited on the package circumference, one after the other, in the sequence of the stroke reversal points 1, 2, 3, 4, 5. As the winding cycle progresses, the individual band widths are symmetrically filled with a certain number of yarns to form a layer. A deposited yarn corresponds in this instance to the yarn length that is deposited on the package during a double stroke of the traversing yarn guide.

This procedure is shown by way of example for the band width between the reversal points 1 and 2 in FIG. 1. However, the filling of a band width proceeds symmetrically. After all band widths are filled, a complete layer with a constant winding ratio is wound. In so doing, the diameter has increased from $D_1$ to $D_2$ (note FIG. 3).

To continue the winding cycle, the package diameter that is now to be newly wound, is again divided into a plurality of band widths. Should it be found in this process that a predetermined limit value is exceeded, a new winding ratio will be computed. The traversing frequency is increased correspondingly suddenly for adjusting the new winding ratio, so that the winding cycle can continue.

A new band width $B_2$ can be determined as follows:

To this end, FIG. 2 shows a front view of a package that has already increased from a diameter $D_1$ to a diameter $D_x$. The diameter $D_1$ is divided into a total of five band widths $B_x$, and the band width has been kept constant during the winding cycle. Thus, $B_1=B_x$. During the filling of the package circumference in band widths, the change in the number of divisions T is to be considered the limit value. As soon as the next higher integral number of divisions is determined, which is realized almost in every layer in the case of large package diameters, a jump will occur to an adjacent step with a newly computed winding ratio.

Figure 3:
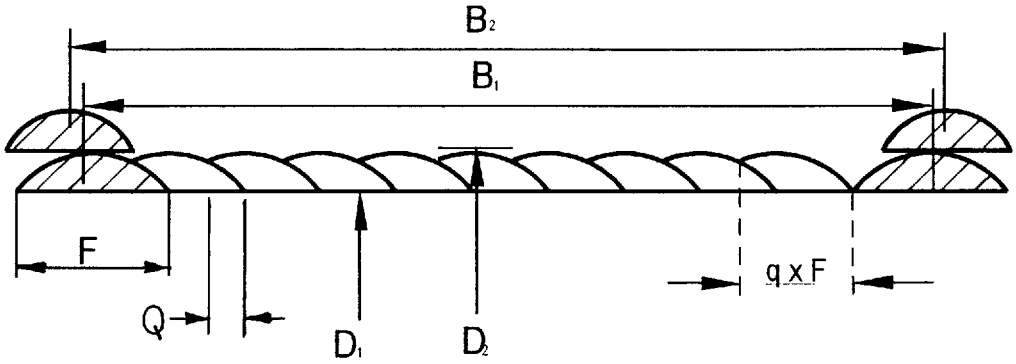
FIG. 3 illustrates a band width with yarns deposited therein.

As previously described, in the present method the band width B is filled with a certain number of yarns as the winding cycle progresses. To this end, another example is shown in FIG. 3, wherein the band width $B_1$ is filled with a total number of nine yarns (A=9). The deposit width of the yarns equals F. To obtain a stable package buildup, the yarns are deposited within the band width B with a certain overlap to one another. The overlap Q may be deposited between the extremes from a complete overlap to no overlap. The overlap Q may be determined by a squeeze factor q. In this connection, when the yarns overlap completely, the squeeze factor q equals zero, and when the yarns are deposited without overlapping, the squeeze factor q equals 1. From this relation, the band width B can be computed from the number of deposited yarns A, deposit width F, and squeeze factor q, as follows:

$$B=A\cdot q\cdot F+F.$$

From this, it follows that with a constant squeeze factor, the band width will increase proportionately with the number of deposited yarns. Thus, a predetermined minimum number of yarns corresponds to a minimum band width $B_{min}$. Likewise, a predetermined maximum number of deposited yarns results in a next largest band width $B_{max}$.

As shown in FIG. 3, a first layer is completely wound on the package circumference with nine yarns being deposited with an overlap in each band width. The package diameter to be newly wound now results in a larger band width $B_2$ while the number of divisions remains unchanged. The band width $B_2$ is again filled with yarns to a layer. In so doing, it is necessary to change the number of yarns or the overlap of the yarns, so as to fill the larger band width $B_2$.

In the method of the present invention, it is important that the ratio of package circumference to band width always results in a whole-numbered multiple. Only thus is it ensured that the package circumference can be evenly covered with yarns. Thus, the following equation applies to the number of divisions T:

$$T=(D\cdot\pi)/B=D\cdot\pi/(A\cdot q\cdot F+F).$$

For the integral number of divisions:

$$T_z=(\text{int})T.$$

The cross-wound package is now being wound within one step at a constant winding angle, until all band widths on the circumference of the package are filled with the predetermined number of yarns. The wind ratio of the step $K_s$ thus results from the following equation:

$$K_s=G+A/(A\cdot T_z+1),$$

where G is the cardinal number of the actual winding, i.e. the digit before the decimal point of the momentary winding ratio.

A deposited yarn is the yarn length that is deposited on the package circumference during one double stroke. Since the wind ratio, namely the ratio of package speed to traversing frequency or double stroke frequency, is constant within the step, the number of double strokes is known until the layer is wound, or the band widths on the package circumference are filled. Thus, after $(G\cdot(T_z\cdot A+1)+T_z)$ double strokes, a new layer is started to wind a new diameter. When a new layer is reached, the winding can now be continued as follows:

The previous winding ratio $K_s$ is maintained. The band width B and the number of deposited yarns A remain constant in this instance. In the event that the diameter increase does not allow a change in the number of divisions $T_z$, the squeeze factor q will be decreased automatically. Thus, the overlap of the yarns that are deposited within the band width is reduced. Only at the limit $Q_{max}\leqq 1$, i.e. no overlap, will a new division $T_z$and, thus, a new $K_S$ value be computed with a determined $Q_{min}$. The new $K_S$ value indicates the winding ratio of the next step. Consequently, the traversing frequency is suddenly increased, so as to wind at a constant circumferential speed of the package the wind in an adjacent step with a changed winding ratio.

However, the start of a new layer may also occur in such a manner that the squeeze factor q, i.e., the overlap of the yarns remains constant within the band width B. In this instance, the number of the yarns A that are deposited within the band width is increased, so that the increased diameter is compensated and, thus, a constant division $T_z$ can be maintained. This continues until a maximum number of yarns $A_{max}$ is reached. At that point, a new division $T_z$ from the package diameter to be wound is computed with a minimum number of deposited yarns $A_{min}$ and, thus, from a minimum band width $B_{min}$. Thereafter, the new winding ratio is computed and, accordingly, the traversing frequency is suddenly increased. It is then possible to wind the new step.

In the case of larger package diameters, however, it is also possible to keep constant the number of the deposited yarns A and the overlap Q. In this instance, it is required that the package diameter be divided into a large number of band widths. After finish winding a layer on the package circumference, the diameter increase will then again result in a new integral number of divisions $T_z$. From that, the winding ratio to be wound in the next step is computed, and the traversing frequency is increased accordingly.

However, to optimize the unwinding characteristics of the package being wound, it will also be of advantage, when the criteria for determining the steps are changed during the entire winding cycle. It has thus been found that a package with variable overlaps in the starting range and a constant overlap in the range of larger diameters exhibits improved unwinding characteristics.

Figure 4:
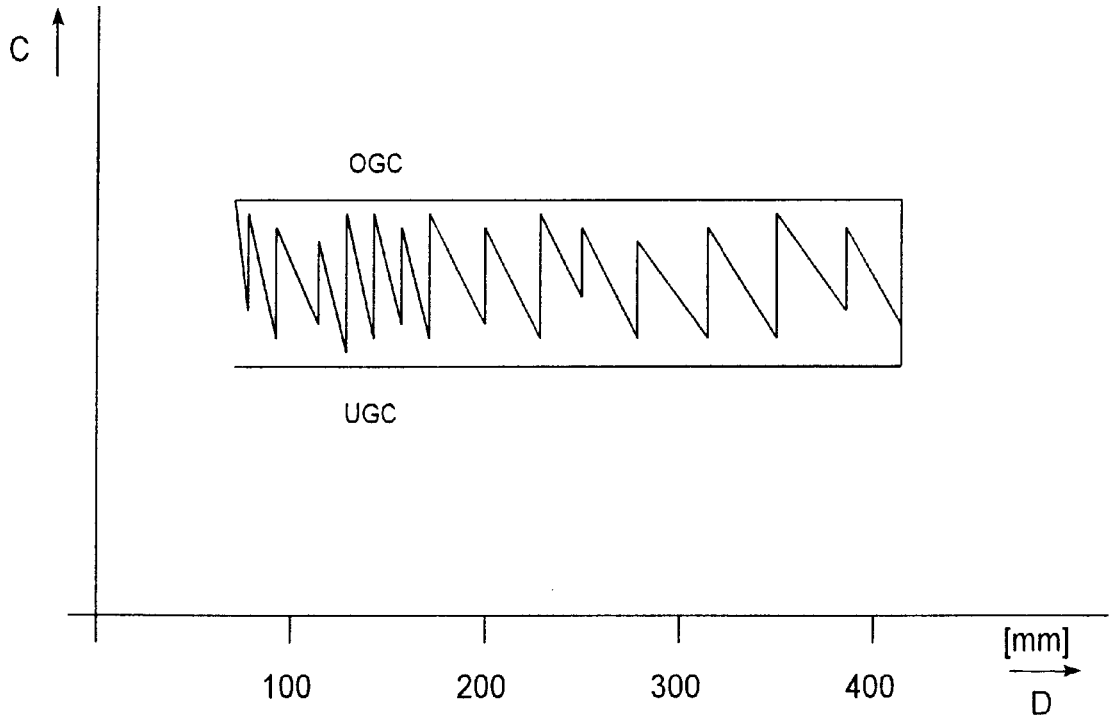
FIG. 4 is a diagram with the course of the traverse speed plotted against the package diameter.

FIG. 4 illustrates a typical traverse diagram for a step precision wind with the package diameter D on the abscissa and the traversing speed C on the ordinate. It is shown that on a tube with a diameter of 100 mm, a yarn is wound to a package with a final diameter of 450 mm. Since the speed of the yarn advancing to the package is constant, and since it is necessary for this reason that the surface speed of the package remain constant despite the increasing diameter, the rotational speed of the winding spindle decreases hyperbolically in the course of the winding cycle. It is also necessary that the tension of the yarn on the package remain within certain limits for purposes of realizing a proper package buildup. For this reason, the traversing speed must remain within predetermined limits. To this end, the diagram of FIG. 4 shows an upper limit OGC and a lower limit UGC.

In each phase of the winding cycle or diameter increase a certain winding ratio $K_S$ is predetermined constant. A constant winding ratio $K_S$ during a winding phase means that the traversing speed decreases proportionately to the spindle speed. This decrease of the traversing speed continues until a new number of divisions is computed. The steps for determining a new winding ratio are determined by a programmable computer. In this computer, the limits OGC and UGC of the traversing speed are input. Since the number of double strokes necessary for winding one layer can be predetermined, the computer is in a position to determine beforehand the extent, to which the lower limit value is reached while the traversing frequency decreases. In the event that the lower limit value is exceeded, a correction will be made by changing the overlap or the number of the deposited yarns. At the end of a step, the traversing speed is suddenly increased. During this sudden increase, a new winding ratio $K_S$ is computed, which is smaller than the previously wound winding ratio.

Figure 5:
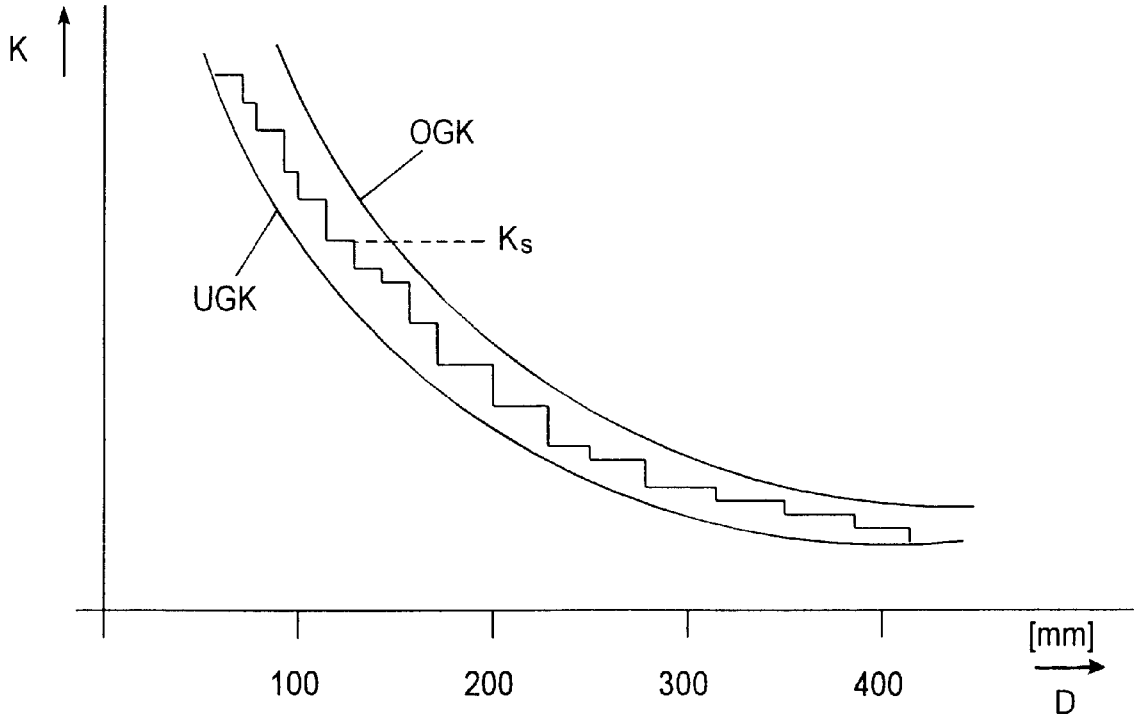
FIG. 5 is a diagram with the course of the winding ratio plotted against the package diameter.

To this end, FIG. 5 shows a diagram with package diameter D as abscissa and winding ratio K as ordinate. Accordingly, an upper limit value OGK of the winding ratio results based on the limited traversing frequency. The lower limit of the winding ratio is defined by the permissible winding angle that is still to be wound. This results in that the upper limit value of the traversing frequency is a constant value. In the diagram of FIG. 5, the respective steps in which the package diameter is wound are indicated at $K_S$. As a result of the many possibilities of controlling the yarn deposit, it is possible to adjust any step that is desired during the winding cycle. In this connection, it is possible to travel through a stepped curve, which facilitates an approximately hyperbolic course. Thus, it is possible to maintain an approximately constant winding angle during the winding. To this end, a large number of steps is needed, which can be realized by predetermining a correspondingly small band width as well as a small number of yarns that are deposited within the band width. However, it is also possible to generate during the winding cycle a stepped curve with as few steps as possible. In this instance, use is made of the entire band width of the permissible winding angle.

That which is claimed is:

1. A method of winding a textile yarn into a core supported package utilizing a stepped precision wind process wherein the yarn is guided onto the rotating package by a traversing yarn guide which defines a traversing frequency, and which includes the steps of (a) depositing a plurality of bands of uniform width B1 on the package circumference having a diameter D1 at an initial winding ratio K1, with each band being defined between two adjacently deposited yarns, and so as to result in an integral number of divisions T1 which equal D1·π/B1, (b) filling each band width with a predetermined number A of deposited yarns with a predetermined overlap Q to form a layer, then (c) dividing the circumference of the newly formed package diameter D2 into newly determined bands B2 of uniform width and so as to result in an integral number of divisions T2 which equal D2·π/B2, and (d) in the event a predetermined limit value is reached in determining the band width B2, computing a new winding ratio K2 for the newly formed package diameter D2 and then increasing the traversing frequency to achieve the new winding ratio K2 to begin the next step of the stepped precision wind.

2. The winding method as defined in claim 1 wherein the predetermined limit value comprises a predetermined number of divisions T2 of the newly formed package diameter D2.

3. The method as defined in claim 1 wherein steps (c) and (d) are performed while maintaining the band width constant, and with the number of deposited yarns A and/or the overlap Q being changed.

4. The method as defined in claim 1 wherein the predetermined limit value comprises a maximum number of deposited yarns Amax which can be deposited within a band width with constant overlap Q.

5. The method as defined in claim 4 wherein step (c) includes computing the integral number of divisions T2 so as to have a minimum number of deposited yarns Amin.

6. The method as defined in claim 1 wherein the predetermined limit value comprises a maximum overlap Qmax which results from a given number of yarns A within a given band width.

7. The method as defined in claim 6 wherein step (c) includes computing the integral number of divisions T2 so as to have a minimum overlap Qmin.

8. The method as defined in claim 1 wherein the predetermined overlap Q is less than a deposit width F of the yarn.

9. The method as defined in claim 8 wherein the predetermined overlap Q is in the range from 0 to 0.5 the deposit width F.

10. The method as defined in claim 1 wherein the step of increasing the traversing frequency to achieve a new winding ratio includes maintaining the traversing frequency within a predetermined upper limit and a predetermined lower limit.

11. A method of winding a textile yarn into a core supported package comprising the steps of winding the yarn about the core at a substantially constant rate and such that the rotational speed of the package gradually decreases, while guiding the yarn onto the core by a traversing yarn guide which defines a traversing frequency, with the speed of the traversing frequency decreasing in proportion to the decreasing rotational speed of the package to define a substantially constant winding ratio during each of a series of sequential winding steps, and rapidly increasing the traversing frequency at the beginning of each sequential winding step to produce a stepped precision wind, and wherein the sequential winding steps include the steps of (a) depositing a plurality of bands of uniform width B on the package circumference having a diameter D1 at an initial winding ratio K1, with each band being defined between two adjacently deposited yarns, and so as to result in an integral number of divisions T1 which equals D1·π/B1, (b) filling each band width with a predetermined number A of deposited yarns with a predetermined overlap Q to form a layer, then (c) dividing the circumference of the newly formed package diameter D2 into newly determined bands B2 of uniform width and so as to result in an integral number of divisions T2 which equal D1·π/B2, and (d) in the event a predetermined limit value is reached in determining the band width B2, computing a new winding ratio K2 for the newly formed package diameter D2 and then increasing the traversing frequency to achieve the new winding ratio K2 to begin the next step of the stepped precision wind.

12. The method as defined in claim 11 wherein the predetermined overlap resulting from step (b) is less than 0.5 of a deposit width F of the yarn.

* * * * *

UNITED STATES PATENT AND TRADEMARK OFFICE

Certificate

Patent No. 6,027,060 Patented: February 22, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Peter Siepmann and Frank Pannwitz.

Signed and Sealed this Thirty-First Day of October, 2000.

DONALD P. WALSH
*Supervisory Patent Examiner*
Art Unit 3653